US006752515B2

(12) United States Patent
Evans et al.

(10) Patent No.: US 6,752,515 B2
(45) Date of Patent: Jun. 22, 2004

(54) APPARATUS AND METHODS FOR PROVIDING EMERGENCY LIGHTING

(75) Inventors: Donald F. Evans, Pinehurst, NC (US); Robert O. Brady, Sarasota, FL (US); Joel R. Chartier, Bradenton, FL (US); Thomas E. Johnson, Northbrook, IL (US)

(73) Assignee: Cyberlux Corporation, Pinehurst, NC (US)

( * ) Notice: Subject to any disclaimer, the term of this patent is extended or adjusted under 35 U.S.C. 154(b) by 0 days.

(21) Appl. No.: 10/060,711

(22) Filed: Jan. 30, 2002

(65) Prior Publication Data

US 2002/0149929 A1 Oct. 17, 2002

Related U.S. Application Data

(60) Provisional application No. 60/283,898, filed on Apr. 16, 2001.

(51) Int. Cl.[7] ..... F21L 4/02; F21V 33/00

(52) U.S. Cl. ..... 362/184; 362/247; 362/295; 362/545; 362/800; 340/815.45

(58) Field of Search ..... 362/247, 295, 362/184, 800, 545; 340/815.45

(56) References Cited

U.S. PATENT DOCUMENTS

| | | | | | |
|---|---|---|---|---|---|
| 4,942,507 | A | | 7/1990 | Wagener | |
| 5,136,491 | A | | 8/1992 | Kano | |
| 5,233,773 | A | * | 8/1993 | Reynolds | 40/661.03 |
| 5,384,693 | A | * | 1/1995 | Schwaller et al. | 362/473 |
| 5,685,631 | A | | 11/1997 | Dobert et al. | |
| 5,797,672 | A | | 8/1998 | Dobert | |
| 5,800,051 | A | | 9/1998 | Gampe et al. | |
| 5,947,588 | A | | 9/1999 | Huang | |
| 6,010,228 | A | | 1/2000 | Blackman et al. | |
| 6,013,985 | A | | 1/2000 | Green et al. | |
| 6,086,220 | A | | 7/2000 | Lash et al. | |
| 6,095,661 | A | | 8/2000 | Lebens et al. | |
| 6,139,172 | A | * | 10/2000 | Bos et al. | 362/494 |
| 6,149,283 | A | | 11/2000 | Conway et al. | |
| 6,190,020 | B1 | * | 2/2001 | Hartley | 362/184 |
| 6,206,541 | B1 | * | 3/2001 | Landamia | 362/184 |
| 6,227,679 | B1 | | 5/2001 | Zhang et al. | |
| 6,234,645 | B1 | | 5/2001 | Börner et al. | |
| 6,234,648 | B1 | | 5/2001 | Börner et al. | |
| 6,250,774 | B1 | | 6/2001 | Begemann et al. | |
| 6,280,480 | B1 | * | 8/2001 | Tuttle et al. | 362/518 |
| 6,357,893 | B1 | * | 3/2002 | Belliveau | 362/285 |
| 6,386,730 | B1 | * | 5/2002 | Matthews | 362/184 |

* cited by examiner

*Primary Examiner*—Stephen Husar
*Assistant Examiner*—James W Cranson, Jr.
(74) *Attorney, Agent, or Firm*—Alston & Bird LLP

(57) ABSTRACT

An improved emergency or interim lighting device and associated methods for providing emergency or temporal lighting. The device satisfies the need for an electrochemical lighting system capable of providing prolonged illumination over the life of the power unit. The device benefits from the use of LEDs as the illumination source, which provide optimum lumen output with considerably less power consumption than conventional incandescent lighting devices. By providing for a unique combination of diode arrangement and parabolic reflector the directional limitations of conventional LED lighting devices are overcome and wide area illumination coverage is provided. Additionally a multi-level lighting scheme provides for a means of identifying the device during electrical power outage and providing multiple levels of lighting intensity.

24 Claims, 6 Drawing Sheets

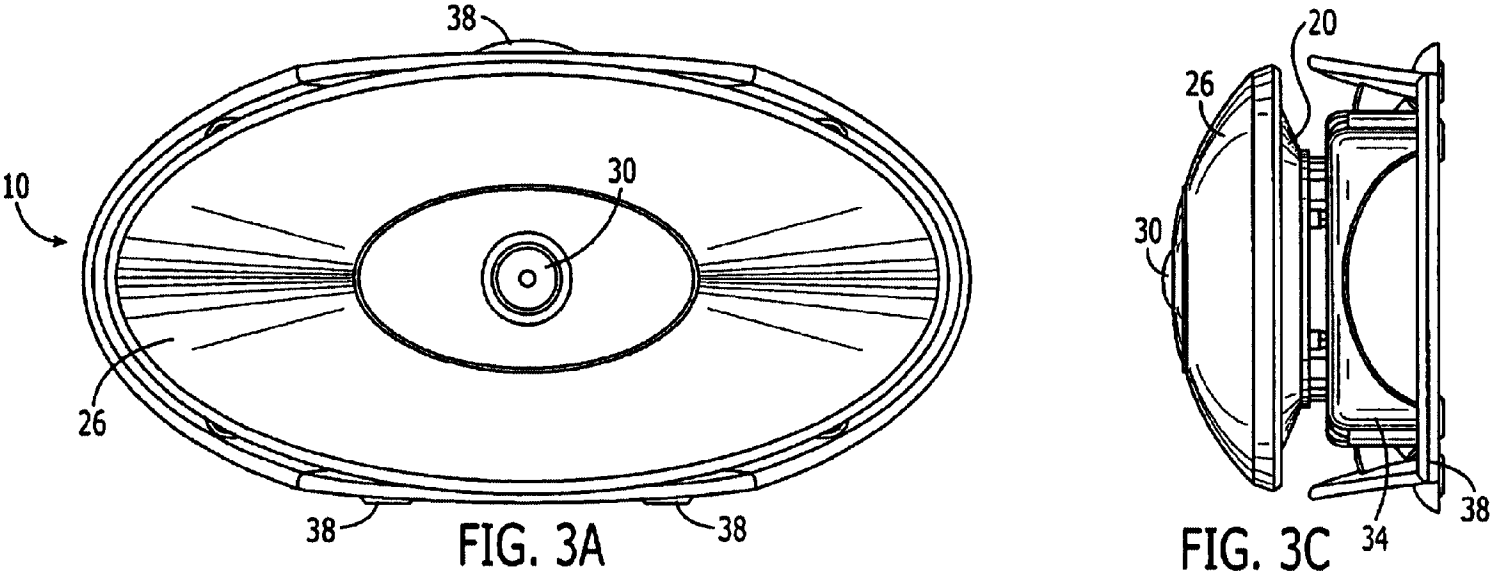
FIG. 3A
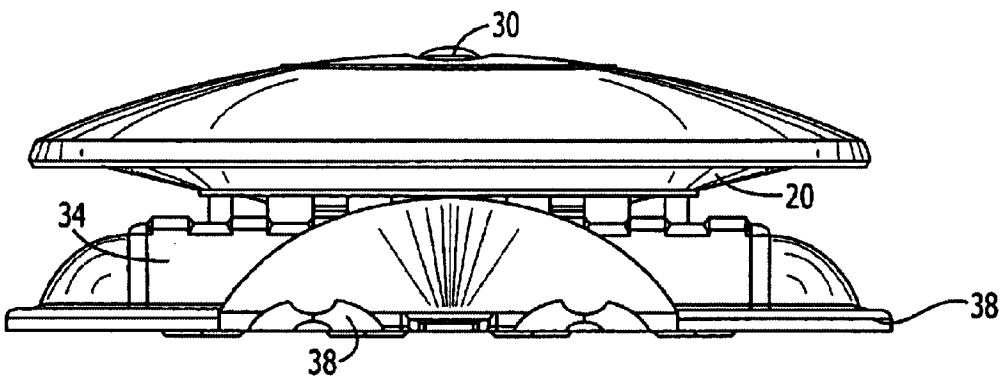
FIG. 3B
FIG. 3C

APPARATUS AND METHODS FOR PROVIDING EMERGENCY LIGHTING

CROSS-REFERENCE TO RELATED APPLICATIONS

The present application claims priority from U.S. Provisional Patent Application Serial No. 60/283,898, filed on Apr. 16, 2001, the contents of which are incorporated by reference.

FIELD OF THE INVENTION

The present invention relates generally to the field of illumination and, more particularly, the invention relates to a solid-state lighting source such as a light-emitting diode (LED) device that provides for multi-level illumination in emergency or temporary situations that demand such.

BACKGROUND OF THE INVENTION

Frequently, homes, offices and industrial plant facilities experience many types of emergency situations involving power failures where an interior or an exterior area has no light. Electrical short circuits, brownouts, fire, accidents, natural disasters (i.e. floods, hurricanes, tornadoes, etc.) or a planned shutdown of electricity may cause these power failures to a facility or dwelling. As a result of these emergencies, most facilities, and especially residential homes, do not have emergency generators to provide temporary back-up lighting or are limited to emergency lighting in the form of portable light sources, such as flashlights or lanterns.

Conventionally, incandescent light bulbs have been used in most of the emergency lighting devices, such as flashlights. However, incandescent bulbs are generally inefficient in terms of energy use and subject to frequent replacement due to their limited lifetime. Light Emitting Diodes (LEDs) have become an attractive alternative as a lighting source in emergency lighting devices. LEDs consume a fraction of the energy used to illuminate incandescent bulbs, therefore costly electrochemical power, typically battery power, is preserved. By comparison, LEDs implemented in a lighting array will require ninety percent less energy to produce optimum lumen output than that required by a similar incandescent lighting element. Additionally LEDs have a much longer use-life than conventional incandescent bulbs. However, in battery operated devices as electrical power is withdrawn from the cell, the voltage available across a given current load will decrease. This decreased available voltage across the given load causes reduced light output, gradually dimming the light as the battery charge depletes. LEDs have voltage, current and power parameters that must be controlled in order to maximize the extended device life. For an example of a flashlight device incorporating the use of LEDs see U.S. Pat. No. 6,095,661, entitled "Method and Apparatus for an LED Flashlight", issued on Aug. 1, 2000 in the name of inventor Lebens et al.

While LEDs have many exciting and practical characteristics that make them attractive to new applications, they also present technical limitations such as narrow band spectra, extremely directional light distribution, and reliability concerns. Attempts have been made to address the directional limitations in numerous inventive ways. See for example, U.S. Pat. No. 6,227,679, entitled "LED Light Bulb", issued on May 8, 2001 in the names of inventors Zhang et al. The Zhang '679 patent addresses the directional limitations by providing for an array of LEDs in which the individual LED units are concentrically mounted and point at various angles to attempt to provide equal light intensity throughout the viewable lighting area.

Reflection means have also been implemented to try and compensate for the directional limitations of the LED. See for example, U.S. Pat. No. 6,234,645, entitled "LED Lighting System for Producing White Light", issued on May 22, 2001, in the name of inventors Borner, et al. In the Borner '645 patent an array of LEDs are mounted on the periphery of a circle and pointing in the direction of the reflector and the area to be lighted. The light emitted from the LEDs is reflected off of a conical shaped reflector and directed outward. Also see for example, U.S. Pat. No. 6,149,283, entitled "LED Lamp With Reflector and Multicolor Adjuster", issued on Nov. 21, 2000, in the name of inventors Conway et al. The Conway '283 patent teaches the use of an array of LEDs disposed in a circular array and pointed toward a reflector and away from the area to be lighted. The light emitted from the LEDs is reflected off a circular, dome shaped reflector and directed outward toward the area to be illuminated. While these reflection means have made some improvements in providing LED light with greater directional capacity, further improvements are still desired to provide broader illumination coverage in emergency lighting devices that implement LEDs.

A need exists to develop an electrochemical LED lighting system capable of providing prolonged illumination over the life of one battery pack. By providing for long-term, interim illumination a solution to electrical service disruption will be gained, especially in areas such as stairwells, bathrooms, corridors, kitchens and offices.

An additional need exists to develop an LED lighting device that is capable of providing wide area illumination coverage. By providing for a device with wide area illumination coverage the device will have useful application in a variety of tasks that include building trades, maritime operations, recreational camping and the like. Additionally, the device should provide for a highly portable unit that can affixed to walls or ceilings, or a free-standing unit that can be positioned on a table, counter or the like.

Also, a need exists to develop a multi-level lighting scheme that will provide identification of the lighting device and the immediate surrounding area so that the device can be located when electrical service interruption occurs. The multi-level lighting scheme should also provide different levels of lighting (i.e., mid-level illumination and maximum illumination) to accommodate the degree of lighting necessary to sufficiently illuminate the area.

SUMMARY OF THE INVENTION

The present invention provides for an improved emergency or interim lighting device and associated methods for providing emergency or temporal lighting. The device of the present invention satisfies the need for an electrochemical lighting system capable of providing prolonged illumination over the life of the electrochemical power unit. The device benefits from the use of light emitting diodes (LEDs) as the illumination source, which provide optimum lumen output with considerably less power consumption than conventional incandescent lighting devices. By providing for a unique combination of diode arrangement and reflector the present invention overcomes the directional limitations of conventional LED lighting devices and results in wide area illumination coverage. Additionally the multi-level lighting scheme of the present invention provides for a means of identifying the device during electrical power outage and providing multiple levels of lighting intensity.

In one embodiment of the invention a lighting device that is capable of providing long-term, interim lighting includes an array of Light Emitting Diodes (LEDs) in electrical communication with corresponding electrical circuitry. The array will typically be configured in an elliptical pattern although other patterns such as generally conical, generally circular and the like are also feasible and within the inventive concepts herein disclosed. In one specific embodiment the LEDs comprise both amber and white LED units. The device also includes a means for providing electrical energy to the array of LEDs. In many embodiments the chosen source for electrical energy will be a direct current source, such as an electrochemical source. However, it is also possible to provide energy to the LEDs via other forms such as solar power, conventional alternating current power or any other means of supplying electrical energy.

The lighting device also includes a parabolic reflector positioned proximate to the array of light emitting diodes that reflects light from the LEDs to provide a wide area coverage of illumination. The geometric relationship between the LEDs and the parabolic reflector aids in dispersing the lumen output such that the lighting device is capable of broadcasting a wide-area blanket of light from the reflector. In one embodiment of the invention the elements comprising the LED array face inward toward the parabolic reflector with the reflected light be transmitted outward toward the area to be illuminated.

In another embodiment of the invention a lighting device that is capable of providing multi-level illumination includes an array of LEDs in electrical communication with a circuit board, the array comprising one or more low luminance LEDs and one or more high luminance LEDs. The array will typically be configured in an elliptical pattern although other patterns such as generally conical, generally circular and the like are also feasible. In one specific embodiment the low luminance LEDs comprise amber LED units and the high luminance LEDs comprise white LED units. The device also includes a means for providing electrical energy to the array of LEDs. In many embodiments the chosen source for electrical energy will be a direct current source, such as an electrochemical source.

This embodiment will also include electrical circuitry disposed on the circuit board that provides for engaging the one or more low luminance LEDs in a first level of illumination, engaging the one or more high luminance LEDs in a second level of illumination and engaging the one or more low luminance LEDs and the one or more high luminance LEDs in a third level of illumination. Additionally the electrical circuitry may include a means for accelerating the flow of electricity to the high luminance LEDs to increase the intensity of light output by the lighting device.

In another embodiment of the present invention a multi-level security illumination device includes a switch for engaging multiple levels of illumination and a processor in electrical communication with the switch that determines the level of illumination based on signals from the switch. The device additionally includes a first bank of light emitting diodes in electrical communication with the processor that provides low intensity illumination based on signals from the processor and a second bank of light emitting diodes in electrical communication with the processor that provides high intensity illumination based on signals from the processor. Additional processing means are provided for that increase current to the second bank of light emitting diodes to affect a maximum amplification level of illumination.

The invention is also defined by a method for multi-level illumination. The method comprises the step of engaging one or more low luminance Light Emitting Diode (LEDs) that are disposed in a LED array to provide first level illumination for the purpose of illuminating the location of the light source, followed by the step of disengaging the one or more low luminance LEDs and engaging one or more high luminance LEDs that are disposed in the LED array to provide second level illumination for the purpose of illuminating a specified area proximate the light source. The method follows with the step of engaging the one or more low luminance LEDs, in conjunction with the previously engaged one or more high luminance LEDs to provide third level illumination for the purpose of further illuminating the specified area proximate the light source. Additionally the method may comprise the step of accelerating the flow of electricity to the one or more high luminance LEDs for the purpose of increasing the intensity of illumination to a maximum amplification.

As such the present invention provides for an LED lighting system capable of providing a prolonged interim illumination solution in instances where electrical service disruption occurs. In the electrochemical energy embodiments this results in long-term use over the lifetime of a single battery pack. In providing for such devices, the present invention is especially attractive as a temporary lighting alternative in stairwells, bathrooms, corridors, kitchens and offices.

Additionally, the unique geometric combination of the LED array and the parabolic reflector provide for wide area illumination coverage. Such devices will have much needed applicability in a variety of tasks that include building trades, maritime operations, recreational camping and the like.

The multi-level lighting method of the present invention will provide ongoing identification of the lighting device allowing for easy identification of the device in instances in which electrical service disruption occurs. In addition, by providing for different levels of lighting (i.e., mid-level illumination and maximum illumination) to accommodate the degree of lighting necessary the device is capable of preserving battery life and, thus, prolonging the lighting period.

BRIEF DESCRIPTION OF THE DRAWINGS

FIGS. 3A–3C illustrate schematic drawings of the front, bottom and side views of the front housing/lens of the emergency lighting device, in accordance with an embodiment of the present invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
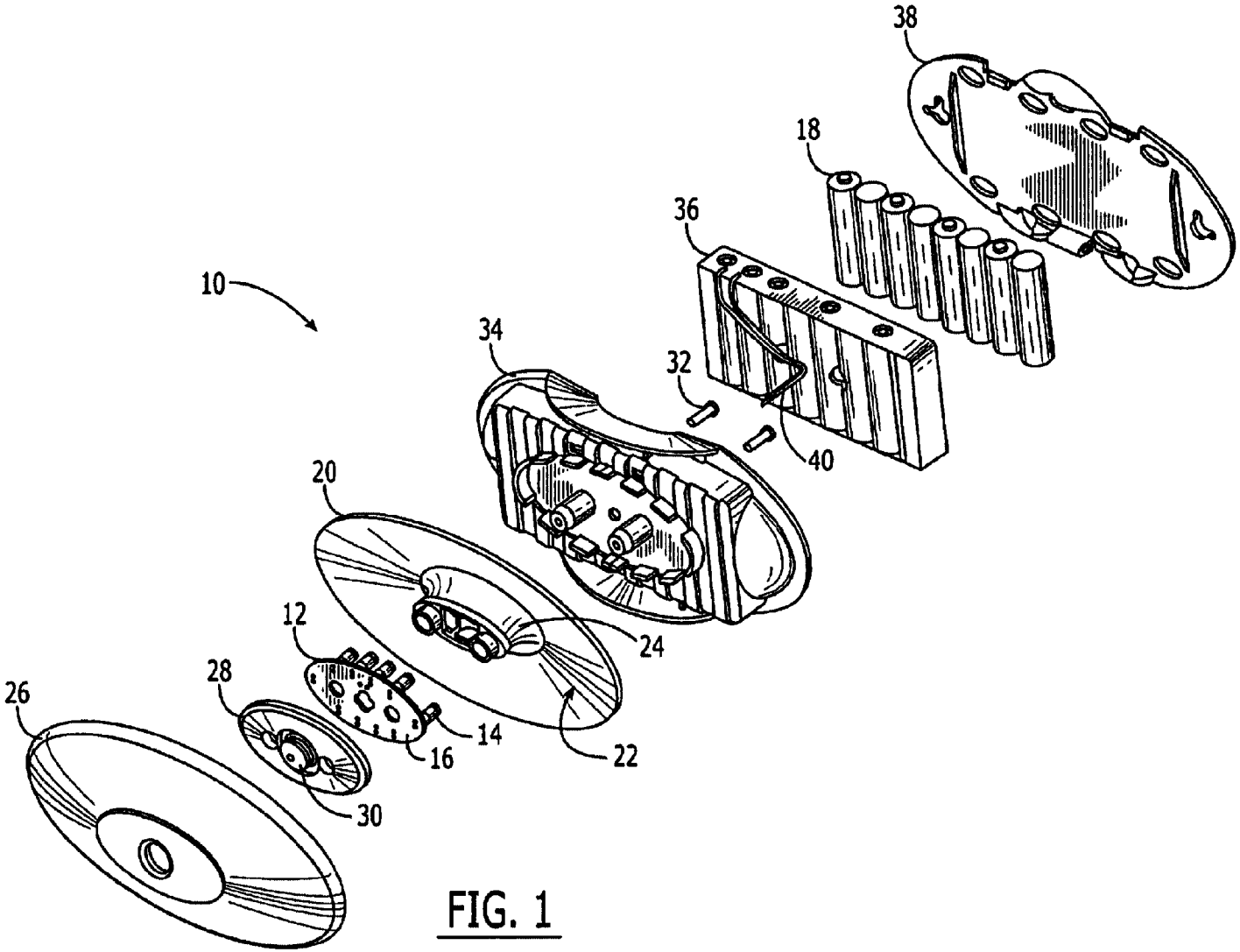
FIG. 1 illustrates an exploded schematic drawing of a front perspective view of various components of the emergency lighting device, in accordance with an embodiment of the present invention.
Figure 2:
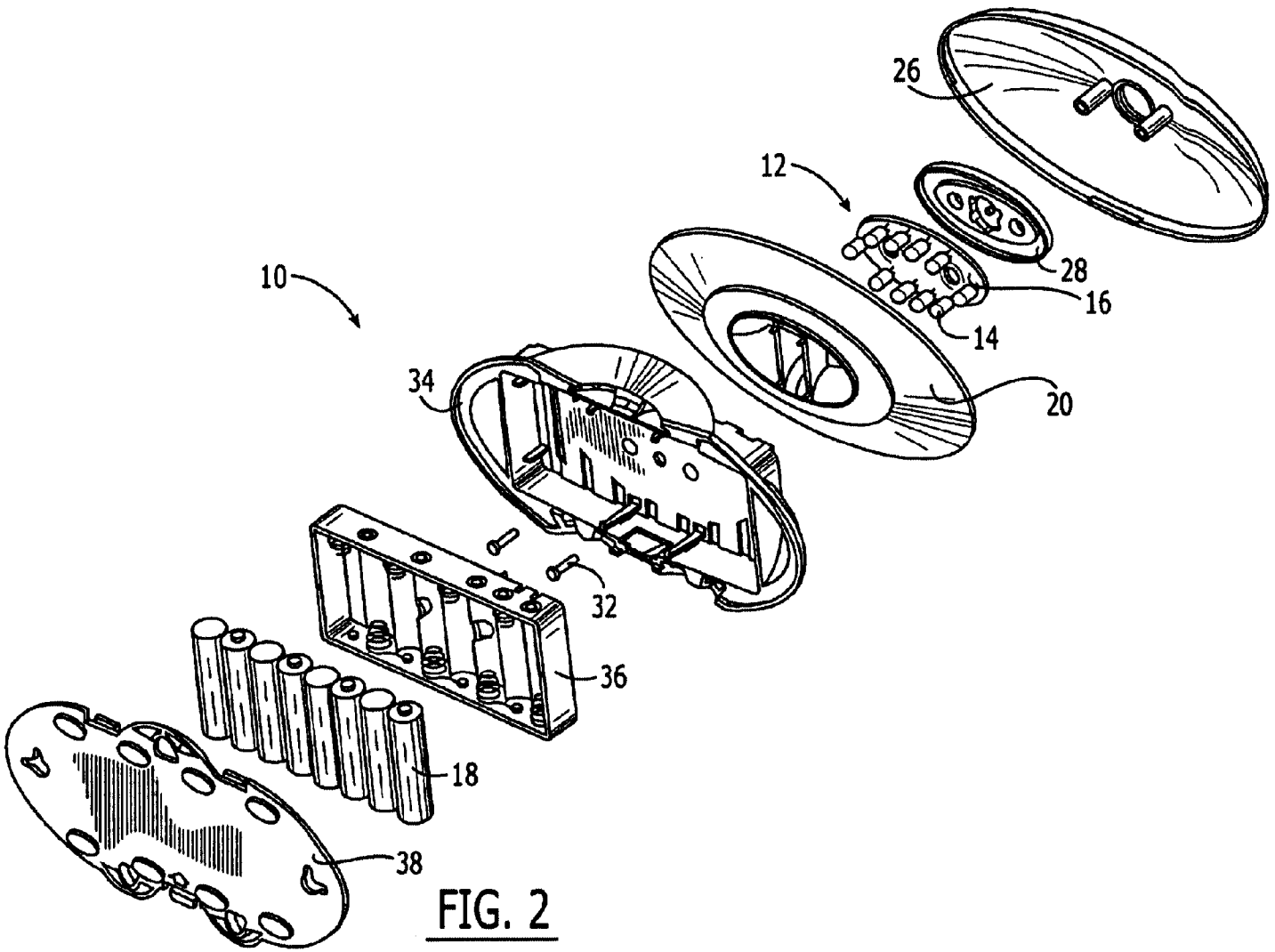
FIG. 2 illustrates an exploded schematic drawing of a back perspective view of various components of the emergency lighting device, in accordance with an embodiment of the present invention.

FIG. 1 and FIG. 2 illustrate schematic drawings of front and back perspectives, respectively, of the various components of an emergency or temporary lighting device, in accordance with an embodiment of the present invention. The lighting device 10 comprises an array of Light Emitting Diodes (LEDs) 12 in electrical communication with corresponding electrical circuitry. In the embodiment of FIGS. 1 and 2 individual LED elements 14 are disposed on a circuit board 16 that houses the corresponding electrical circuitry. It should be noted that the circuit board is, advantageously, generally elliptical in shape and relatively small in size so as to not obstruct reflected light. Additionally, the lighting device includes a means of electrical energy 18 for providing such to the array of LEDs. In the embodiment of FIGS. 1 and 2 the means of electrical energy comprises an electrochemical device, such as a battery pack. A parabolic reflector 20 positioned proximate to the array of LEDs serves to reflect light from the LEDs to provide a wide area coverage of illumination.

In the embodiment depicted in FIGS. 1 and 2 the array of LEDs 12 comprise a generally elliptical pattern of individual LED elements 14 disposed on an elliptically shaped circuit board 16 that includes the corresponding electrical circuitry. The generally elliptical LED array illustrated in FIGS. 1 and 2 is shown by way of example only. It is also possible to configure the array in other patterns, such as generally circular, generally conical or the like, without departing from the inventive concepts herein disclosed. As shown the array includes ten (10) individual LED elements; four (4) LED elements are disposed on each side of the elliptical pattern and two (2) LED elements are disposed on opposite ends of the elliptical pattern. The number of LED elements comprising the array and the positioning of the LED elements is shown by way of example only. Other quantities of LED elements and other positioning schemes are also possible and do not depart from the inventive concepts herein disclosed.

In the embodiment shown in FIGS. 1 and 2 the means of electrical energy 18 comprises an electrochemical energy source, such as a battery pack. While electrochemical power will typically be the electrical energy source of choice, it is also possible for the lighting device of the present invention to be supplied electrical energy from other sources. For example, other direct current electrical sources such as solar power may be implemented and it is also possible to use alternating current sources. The choice of the electrical energy source will typically be dictated by ease of use, reliability concerns and the desired function (i.e., emergency versus temporary) of the lighting device.

The parabolic reflector 20 of the present invention is positioned proximate the array of LEDs 12. As such, the geometric relationship between the LED elements 16 and the reflector aid in dispersing the lumen output resulting in a lighting device is capable of broadcasting a wide-area blanket of light from the reflector. In the embodiment shown in FIGS. 1 and 2 the LED elements are directed inward toward the concave surface of the parabolic reflector. In an assembled device the LED elements will surround the protruding member 24 of the parabolic reflector to insure that the majority of light transmitted from the diodes is reflected against the concave surface of the reflector. The protruding member has a generally curved surface proximate the concave surface 22 of the parabolic reflector and serves to aid in the reflection of the light transmitted by the array of LEDs. Light that is reflected off of the concave surface is then directed outward toward the area of illumination. The concave surface of the parabolic reflector and the exterior surface of the protruding member are typically a highly polished surface to provide the necessary degree of reflectivity. Alternatively, the concave surface of the parabolic reflector and the exterior surface of the protruding member may be coated with a reflective material.

Additional components of the lighting device include the translucent front housing/lens 26 and an activation element 28. The translucent front housing permits the reflected light to be transmitted outward toward the area of lighting concern. The button-like switch 30 disposed on the front face of the activation element 28 is in electrical communication with the circuit board 16 and provides a means for activating/deactivating the lighting device and engaging the multiple lighting levels that the lighting device is capable of providing. In the embodiment shown in FIGS. 1 and 2 the button-like switch protrudes through an aperture in the front housing in the assembled state and allows the user ease in activating/deactivating the lighting device and/or changing between levels of lighting. At a minimum, for example, the switch permits the LEDs to be alternately engaged and disengaged to the power source 18.

The additional components shown in FIGS. 1 and 2 serve to properly encase and assemble the lighting device of the present invention. The activation element 28 is secured to the circuit board 16 assembly via fasteners 32. Additionally the fasteners serve to mechanically connect the LED array 12 to the parabolic reflector 20 and power source connecting unit 34. The power source connecting unit additionally serves as a snap-fit interlocking means for the front housing/lens. However, the front housing/lens may be connected in other manners if desired. The power source connecting unit contains the power source housing 36, which in turn houses the electrical power supply 18. The back housing 38 serves as the power source cover and is configured to be snap-fit interlocked with the power supply connecting unit 34. As with the front housing/lens, the back housing may be connected in other manners, such as by fasteners or the like. The power source connecting unit, the power source housing and the back housing are typically molded from hard polymer materials. Electrical connection between the power source 18 and the circuit board 16 is provided by wiring means 40 that connects the circuit board to the power source housing 36.

FIGS. 3A–3C illustrate front, bottom and side views, respectively, of the assembled lighting device 10, in accordance with an embodiment of the present invention. As shown in FIG. 3A, the translucent front housing/lens 26 has a generally elliptical shape that corresponds with the generally elliptical shape of the internal parabolic reflector (not shown in FIG. 3). At the center of the translucent front housing/lens an aperture exposes the activation element 30, which is positioned to be highly visible to allow for ease in activation/deactivation and lighting level change by a user. The bottom view of FIG. 3B and the side view of FIG. 3C illustrate the snap-fit interlocking aspect of the front housing/lens 26, the power source connecting unit 34 and the back housing 38.

The design of the housing shown in FIGS. 3A–3B illustrate that the lighting device is suitable to various placement alternatives. The generally flat back housing allows the lighting device to be affixed to a wall or ceiling, either by means of a fastener, adhesive engagement or other suitable attachment means. Additionally, the unit can be placed freestanding, in either the horizontal or vertical plane, upon a generally flat surface. The freestanding positioning aspect allows the lighting device of the present invention to be portable. The portable nature of the device provides for useful application in a variety of tasks, including but not limited to, recreational activities, construction industry and maritime operations.

Figure 4A:
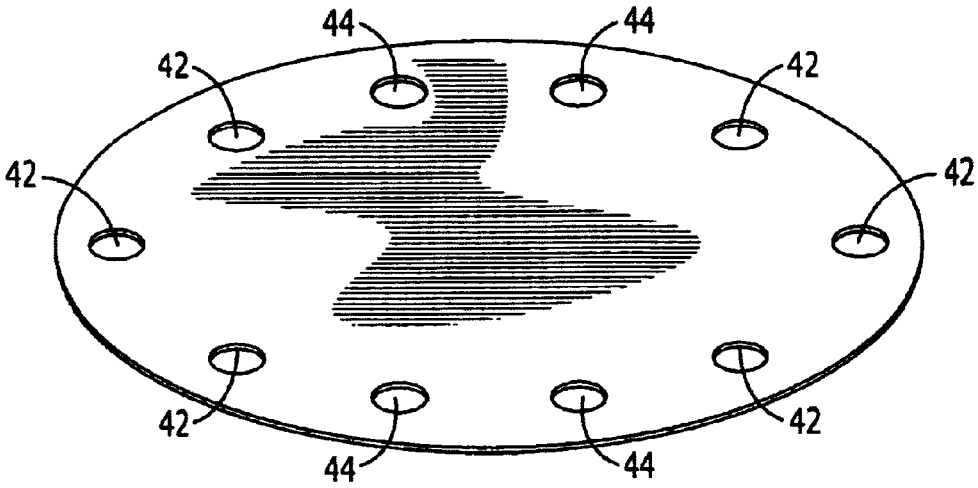
FIGS. 4A–4B illustrate schematic drawings of the plan view of the circuit board and associated LED arrays, in accordance with an embodiment of the present invention.
Figure 4B:
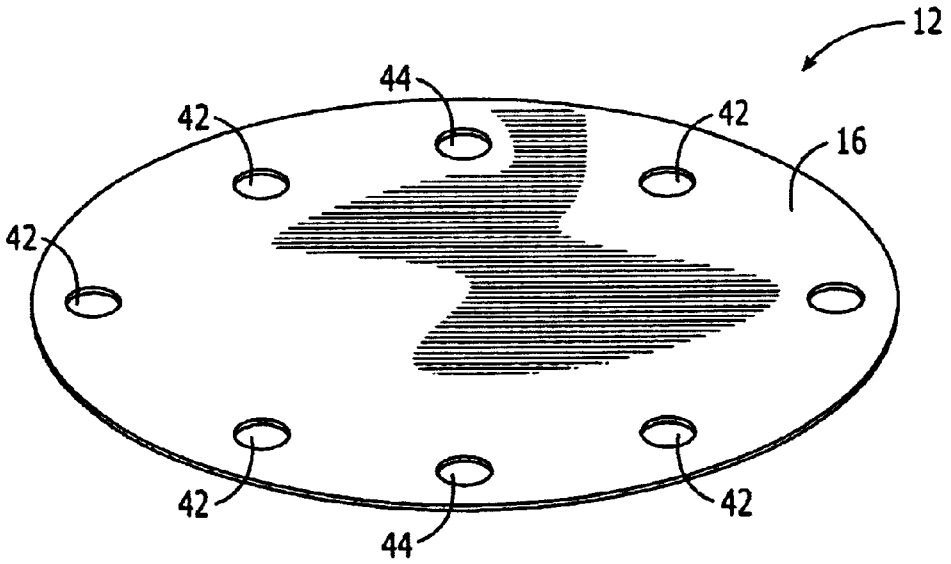

In accordance with another embodiment of the present invention, a lighting device for multi-leveled illumination is defined as including an array of (LEDs) in electrical communication with a circuit board, the array comprising one or more low luminance LEDs and one or more high luminance LEDs. Low and high luminance LEDs are provided to accommodate multi-level lighting. In one embodiment of the invention the low luminance LEDs are amber LEDs and the high luminance LEDs are white LEDs. However, various types of LEDs may be utilized so long as some LEDs have a greater nominal luminance than other LEDs. Typically, the quantity of high luminance LEDs will outnumber the quantity of low luminance LEDs. In the embodiment shown in FIG. 1 a 6:4 or 6:2 high luminance LED to low luminance LED ratio is typical. In typical embodiments, the high luminance LEDs will outnumber the low luminance LEDs. As shown in FIGS. 4A and 4B, the LED array 12 is arranged in a generally elliptical pattern around the periphery of a generally elliptical circuit board 16. In the FIG. 4A embodiment, the 6:4 high luminance LED to low luminance LED ratio is accomplished by providing for 4 low luminance LEDs 44 closest the center axis of the ellipse and 6 high luminance LEDs 42 furthest the center axis of the ellipse. In the FIG. 4B embodiment, the 6:2 high luminance LED to low luminance LED ratio is accomplished by providing for 2 low luminance LEDs 44 closest the center axis of the ellipse and 6 high luminance LEDs 42 furthest the center axis of the ellipse.

In addition, this embodiment of the invention will also include an electrical energy source, typically an electrochemical energy source, such as may be provided by a battery pack. Electrical circuitry will be disposed on the associated circuit board that provides for a multi-level lighting scheme. In a first level the electrical circuitry engages the one or more low luminance LEDs to provide identifying light. Identifying light is typically used if the lighting device is being used as an emergency lighting system. The identifying light allows a user to locate the lighting device once electrical service interruption occurs. Typically, first level lighting will be engaged at the inception of the use of the lighting system and remain active on an ongoing basis. In a second level the electrical circuitry engages the one or more high luminance LEDs to provide an intermediate level of light to the illumination area. The second level of lighting is typically activated by a user to provide adequate lighting to the illumination area. At the intermediate level full use of the battery power is not required and, thus, battery life is preserved. In a third level the electrical circuitry engages both the one or more low luminance LEDs and the one or more high luminance LEDs to provide a maximum level of light to the area of illumination. The third level of lighting is typically activated by the user to provide maximum possible lighting to the illumination area. At the maximum level full use of the batter power is required and, thus, battery life is exhausted at a maximum rate. In alternative embodiments of the invention the electrical circuitry will additionally provide for a means, typically comprised of a number of transistors as described below, for accelerating the flow of electricity to the high luminance LEDs during the third level of lighting to further increase the intensity of light to maximum amplification.

Figure 5:
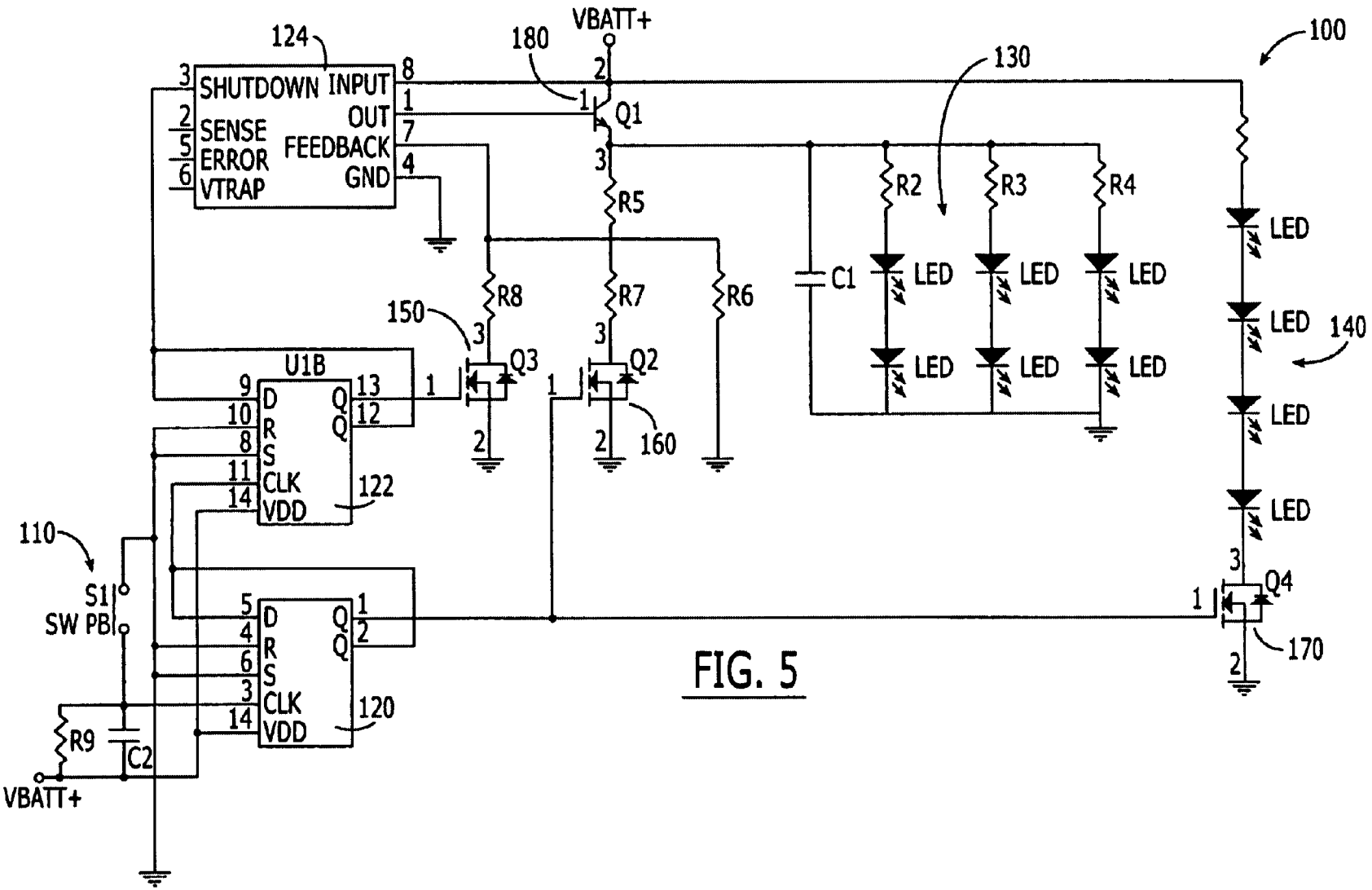
FIG. 5 illustrates an electrical schematic drawing of the lighting circuitry, in accordance with an embodiment of the present invention.

FIG. 5 is an electrical circuit diagram for the multi-level lighting device, in accordance with an embodiment of the present invention. The electrical circuit 100 comprises a switch 110 that is engaged/disengaged to activate the lighting device and alter the level of lighting provided by the lighting device. The integrated circuits 120, 122 and 124 are in electrical communication with the switch and provide the necessary logic to activate/deactivate the lighting system and to alter the level of lighting provided by the lighting device. As shown in FIG. 3 the integrated circuits are three distinct integrated circuits 120, 122 and 124, however; it may also be possible to implement the activation/deactivation logic and level lighting logic in less than three integrated circuits, for example, a single integrated circuit may be feasible. In the illustrated embodiment, however, alternatively, the switch 100 may be switchably connected to the high and low luminance LEDs by a series of switches, such as transistors, or the like, so as to selectively activate/deactivate the LEDs as the switch is activated. The integrated circuits are in electrical communication with a first bank of LEDs 130 that provide high luminance lighting and a second bank of LEDs 140 that provide low luminance lighting. Specifically, integrated circuits 120 and 122 serve to control the activation/deactivation of first and second bank of LEDs.

In addition, the electrical circuit includes gate transistors 150, 160, 170 and bipolar transistor 180. By altering the bias on the transistors the current supplied to the diodes can be increased on decreased, thereby, maximizing the illumination performance of the diodes while minimizing the battery output. Integrated circuit 124 is in electrical communication with the gate transistors and bipolar transistor and serves to control the intensity of the LEDs that are activated.

Figure 6:
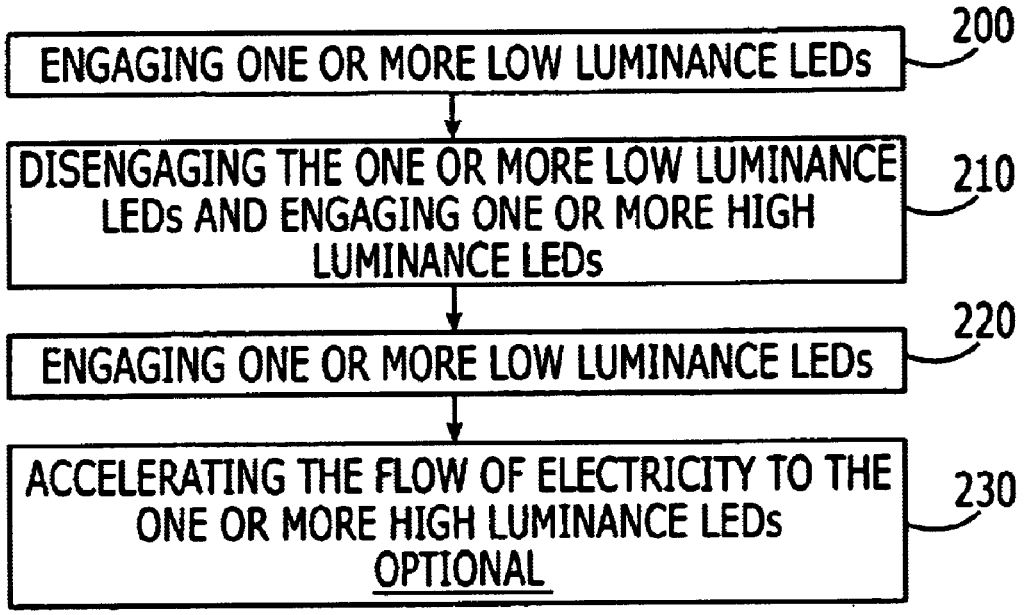
FIG. 6 depicts a flow diagram of a method for multi-level emergency lighting, in accordance with an embodiment of the present invention.

As illustrated in the flow diagram of FIG. 6 the invention is further defined by a method for multi-level illumination. The method comprises the 200 step of engaging one or more low luminance LEDs that are disposed in an LED array to provide a first level of illumination. First level illumination is typically provided to offer ongoing low level illumination of the lighting device for the purpose of identifying the device when an electrical service disruption occurs.

The method further comprises the 210 step of disengaging the one or more low luminance LEDs and engaging one or more high luminance LEDs that are disposed in the LED array to provide second level illumination. Second level illumination is typically provided to offer an intermediate level of lighting. Second level illumination will typically provide adequate lighting in the general vicinity of the lighting device. In one specific embodiment second level illumination provides light sufficient to illuminate about a one hundred square foot space.

At the 220 step the one or more low luminance LEDs are engaged, in unison with the previously engaged high luminance LEDs to provide third level illumination. Third level illumination will typically provide the maximum illumination that the lighting device is capable of providing. Additionally, at optional step 230, third level illumination may comprise accelerating the flow of electricity to the one or more high luminance LEDs for the purpose of increasing the intensity of illumination to a maximum amplification. In applications in which electrochemical power is implemented as the energy source the third level of illumination will deplete the energy source at the fastest rate.

As such the present invention provides for an LED lighting device and methods of emergency system capable of providing a prolonged interim illumination solution in instances where electrical service disruption occurs. In providing for such devices, the present invention is especially attractive as an emergency lighting alternative in stairwells, bathrooms, corridors, kitchens and offices. Additionally, the lighting device provides for a viable alternative to current temporary portable lighting devices and offers lighting solutions for recreational camping, construction site illumination and maritime operations.

By implementing the unique geometric combination of the LED array and the parabolic reflector the lighting device of the present invention can provide for wide area illumination coverage. As such the present invention overcomes the directional limitations that have plagued previous lighting devices that implement LEDs.

The multi-level lighting method of the present invention will provide ongoing identification of the lighting device allowing for easy identification of the device in instances in which electrical service disruption occurs. In addition, by providing for different levels of lighting (i.e., mid-level illumination and maximum illumination) to accommodate the degree of lighting necessary the device is capable of preserving battery life and, thus, prolonging the interim lighting period.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A lighting device capable of providing long-term, interim lighting capabilities, the lighting system comprising:

an array of Light Emitting Diodes (LEDs) in electrical communication with corresponding electrical circuitry;

an electrical energy source for supplying electrical energy to the array of LEDs; and an elliptical parabolic reflector positioned proximate to the array of light emitting diodes that reflects light from the LEDs to provide a wide area coverage of illumination.

2. The lighting device of claim 1, wherein the electrical energy source further comprises a direct current electrical energy source.

3. The lighting device of claim 2, wherein the electrical energy source further comprises an electrochemical energy source.

4. The lighting device of claim 1, wherein the electrical energy source further comprises an alternating current electrical energy source.

5. The lighting device of claim 1, wherein the array of LEDs further comprises a generally elliptical patterned array of LEDs.

6. The lighting device of claim 1, wherein the array of LEDs further comprises an array of low luminance LEDs and high luminance LEDs.

7. The lighting device of claim 6, wherein the low luminance LEDs further comprise amber LEDs and the high luminance LEDs further comprise white LEDs.

8. The lighting device of claim 1, further comprising a translucent front housing that provides for light to be emitted from the lighting device to an area of illumination.

9. The lighting device of claim 8, wherein the translucent front housing further comprises a generally elliptical shaped translucent front housing.

10. The lighting device of claim 8, further comprising an activation element disposed proximate the front housing that allows for activation of the array of LEDs.

11. The lighting device of claim 1, wherein the array of LEDs is positioned to face generally toward the parabolic reflector.

12. The lighting device of claim 11, wherein the array of LEDs is positioned to face in a direction generally opposite the wide area coverage of illumination.

13. A lighting device capable of providing long-term, interim lighting capabilities, the lighting system comprising:

a generally elliptical array of Light Emitting Diodes (LEDs) in electrical communication with corresponding electrical circuitry, the array including low luminance and high luminance LEDs;

an electrochemical energy source in electrical communication with the electrical circuitry for providing energy to the array of LEDs;

an activation element in electrical communication with the electrical circuitry for selectively activating the LEDS to provide multi-level illumination of the lighting device; and a parabolic reflector positioned proximate to the array of light emitting diodes that reflects light from the LEDs to provide a wide area coverage of illumination.

14. The lighting device of claim 13, wherein the activation element is capable of engaging combinations of the one or more low luminance LEDs and the one or more high luminance LEDs to provide multi-level illumination.

15. The lighting device of claim 13, wherein the array of LEDs are positioned to emit light toward a concave surface of the parabolic reflector with the light being reflected from the concave surface and directed in a generally opposite direction from which the array of LEDs emit light.

16. A lighting device capable of providing long-term, interim lighting capabilities, the lighting system comprising:

a generally elliptical patterned array of Light Emitting Diodes (LEDs) in electrical communication with corresponding electrical circuitry;

an electrical energy source for supplying electrical energy to the array of LEDs; and a non-circular parabolic reflector positioned proximate to the array of light emitting diodes that reflects light from the LEDs to provide a wide area coverage of illumination.

17. The lighting device of claim 16, wherein the array of LEDs further comprises an array of low luminance LEDs and high luminance LEDs.

18. The lighting device of claim 16, wherein the array of LEDs is positioned to face in a direction generally opposite the wide area coverage of illumination.

19. A lighting device capable of providing long-term, interim lighting capabilities, the lighting system comprising:

an elliptical patterned array of Light Emitting Diodes (LEDs) in electrical communication with corresponding electrical circuitry;

an electrical energy source for supplying electrical energy to the array of LEDs; and a parabolic reflector positioned proximate to the elliptical patterned array of light emitting diodes that reflects light from the LEDs to provide a wide area coverage of illumination.

20. The lighting device of claim 19, wherein the array of LEDs further comprises an array of low luminance LEDs and high luminance LEDs.

21. The lighting device of claim 19, wherein the array of LEDs is positioned to face in a direction generally opposite the wide area coverage of illumination.

22. A lighting device capable of providing long-term, interim lighting capabilities, the lighting system comprising:

an array of low luminance Light Emitting Diodes (LEDs) and high luminance LEDs in electrical communication with corresponding electrical circuitry;

an electrical energy source for supplying electrical energy to the array of LEDs; and a non-circular parabolic reflector positioned proximate to the array of light emitting diodes that reflects light from the LEDs to provide a wide area coverage of illumination.

23. The lighting device of claim 22, wherein the array of low luminance Light Emitting Diodes (LEDs) and high luminance LEDs further comprises a generally elliptical patterned array of low luminance Light Emitting Diodes (LEDs) and high luminance LEDs.

24. The lighting device of claim 22, wherein the array of low luminance Light Emitting Diodes (LEDs) and high luminance LEDs is positioned to face in a direction generally opposite the wide area coverage of illumination.

* * * * *